United States Patent [19]

Pratt et al.

[11] Patent Number: 4,706,461

[45] Date of Patent: Nov. 17, 1987

[54] AMBIENT AIR MODULATOR FOR ENGINE FLUID HEAT EXCHANGER

[75] Inventors: Howard L. Pratt; Robert J. Selzer, both of Fort Wayne, Ind.

[73] Assignee: Navistar International Transportation Corp., Chicago, Ill.

[21] Appl. No.: 830,381

[22] Filed: Feb. 14, 1986

[51] Int. Cl.[4] ..... F02B 29/04; F01P 7/02

[52] U.S. Cl. ..... 60/599; 165/39; 165/44; 165/51; 165/98; 123/41.04; 123/41.05

[58] Field of Search ..... 165/39, 98, 99, 44, 165/51; 60/599; 123/563, 542, 41.04, 41.05, 41.06

[56] References Cited

U.S. PATENT DOCUMENTS

| | | | |
|---|---|---|---|
| 1,220,794 | 3/1917 | Stephenson | 165/98 |
| 1,254,785 | 1/1918 | Farrell | 165/98 |
| 1,339,269 | 5/1920 | Lundin | 180/68.1 |
| 1,486,012 | 3/1924 | Christy | 165/98 |
| 1,492,897 | 5/1924 | Ryder | 165/99 |
| 1,598,610 | 9/1926 | Hufschmidt | 165/98 |
| 1,613,913 | 1/1927 | Snyder | 165/98 |
| 1,924,654 | 8/1933 | Peterson | 123/41.04 |
| 2,133,924 | 10/1938 | Petersen et al. | 180/68.1 |
| 2,452,300 | 10/1948 | Herreshoff et al. | 123/563 |
| 2,638,881 | 5/1953 | Pankuch et al. | 123/41.05 |
| 2,654,354 | 10/1953 | Sanders | 123/41.05 |
| 3,854,459 | 12/1974 | Stimeling | 165/39 |
| 4,176,630 | 12/1979 | Elmer | 123/41.12 |
| 4,485,624 | 12/1984 | Melchior | 60/599 |

FOREIGN PATENT DOCUMENTS

| | | | |
|---|---|---|---|
| 226076 | 12/1924 | United Kingdom | 123/563 |
| 825270 | 12/1959 | United Kingdom | 60/599 |
| 1255956 | 12/1971 | United Kingdom | 123/563 |

*Primary Examiner*—Albert W. Davis, Jr.
*Assistant Examiner*—John K. Ford
*Attorney, Agent, or Firm*—F. David Aubuchon; Dennis K. Sullivan

[57] ABSTRACT

An ambient air-to-engine fluid heat exchanger, preferably a charge air cooler, for a vehicle having an ambient air modulator in the form of an apertured plate mounted adjacent the face of the heat exchanger and controllably slidable to bring the plate apertures in registry with the ambient air openings of the heat exchanger. If the heat exchanger is for engine coolant, the front face of the heat exchanger comprises a second plate having the heat exchanger ambient air openings therein. If it is a charge air cooler, a second plate is unnecessary because, in an air-to-air heat exchanger, the charge air tubes are about the same width as the ambient air passages and thus the tubes can block the air flow through the modulator apertures when the plate is positioned to do so. The modulator plate is further preferably provided with integral louver portions between the apertures for channelling and streamlining the ambient air flow into the apertures and heat exchanger.

11 Claims, 6 Drawing Figures

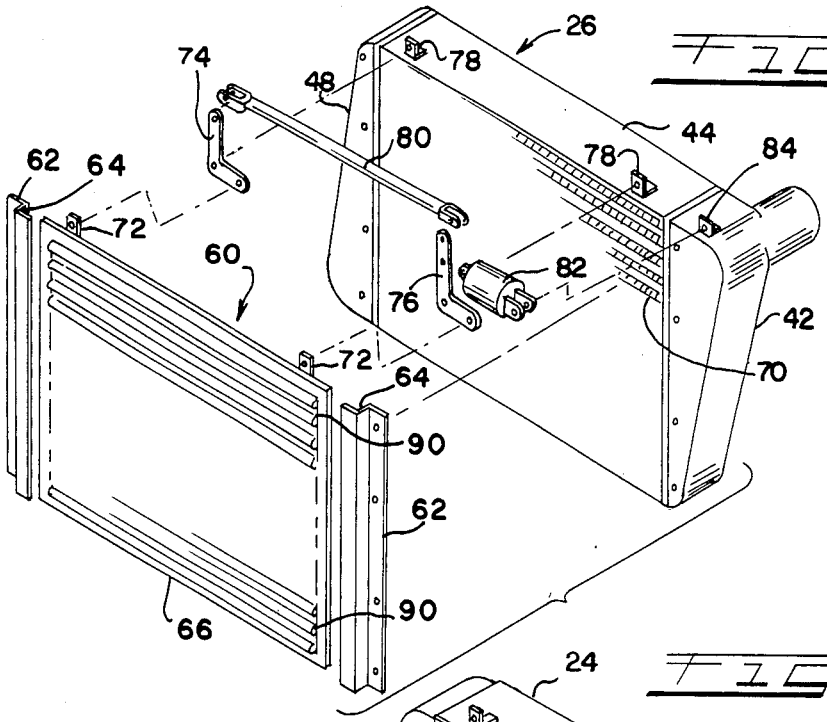
FIG. 4
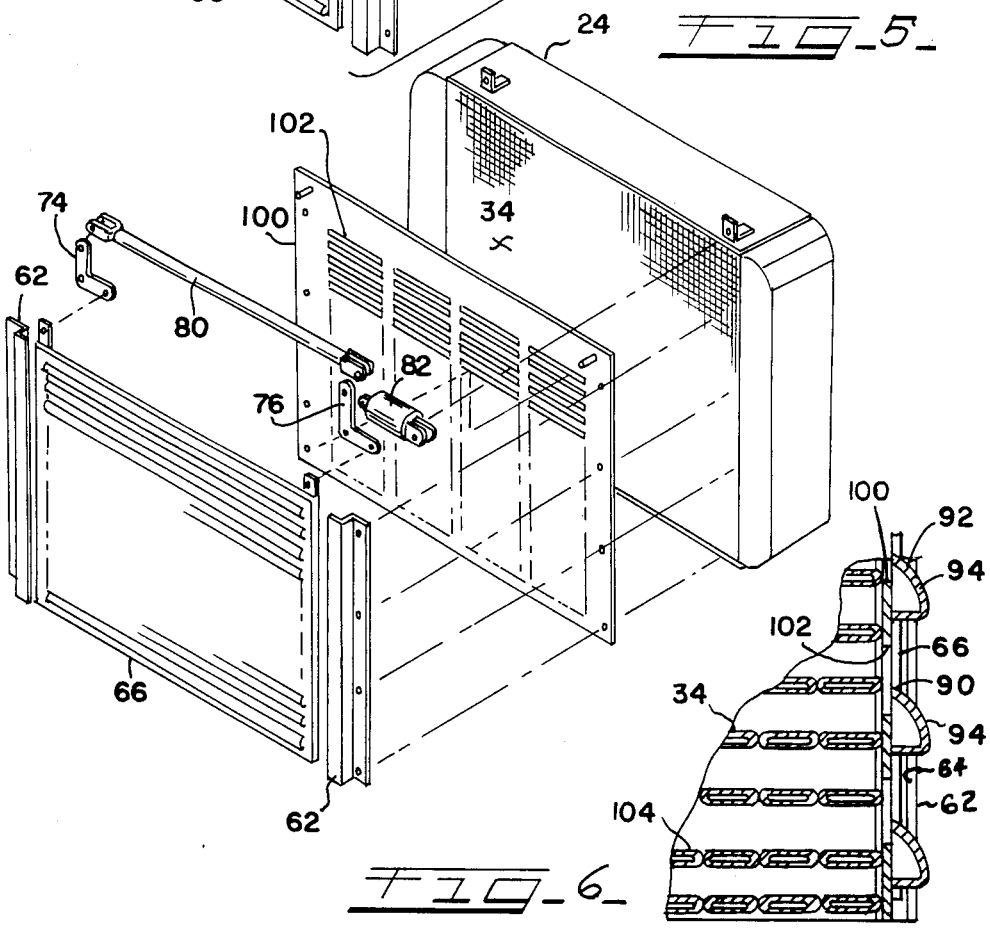
FIG. 5
FIG. 6

AMBIENT AIR MODULATOR FOR ENGINE FLUID HEAT EXCHANGER

BACKGROUND OF THE INVENTION

This invention relates to heat exchangers, such as radiators and charge air coolers, for highway vehicles and more particularly, to an improved ambient air modulator used in conjunction therewith.

THE PRIOR ART

Ambient air modulators for highway vehicles are previously known, for example in U.S. Pat. No. 3,854,459, and generally consist of shutters, that is rotatable louvers, disposed forwardly of the vehicle radiator, which serve to isolate the vehicle engine compartment from the ambient air, especially from the ram air effect experienced when travelling at highway speeds. Such shutters prevent the engine coolant temperature from dropping to levels where the engine will operate less efficiently as may happen especially in the winter. On the other hand, on warmer days, the shutter remains open more often to utilize the full capacity of the vehicle coolant system. These systems have worked well for their intended function; however, they suffer the disadvantages of requiring a few inches of space forward of the radiator which is becoming less available in modern trucks and of involving a large number of parts in their operating mechanisms. Nonrotating louvers are taught in Peterson U.S. Pat. No. 1,924,654; however, much space forward of the radiator is still required to move the louvers fore and aft relative to each other. U.S. Pat. Nos. 2,638,881 and 2,654,354 disclose a pair of flat plates which rotate relatively about a horizontal axis. In both cases the plates are located a substantial distance from the radiator core and therefore use considerable space and do not prevent circulation through the radiator core. Further, in both references, the plates are circular and the flow through area is substantially smaller than the presumptively square radiator core.

Finally, although chassis mounted air-to-air charge air coolers are generally known, for example, in U.S. Pat. No. 4,176,630, applicants are unaware of any teaching of an ambient air modulator used in conjunction therewith although some have bypassed the charge air around the charge air cooler to achieve a similar charge air temperature control.

SUMMARY OF THE INVENTION

A primary object of the invention described and claimed herein is to provide a means for modulating the flow of ambient air through a vehicle-mounted engine fluid heat exchanger which is relatively compact in the fore and aft direction and has few moving parts.

Another object of the invention is to provide an ambient air flow modulator for an engine charge air cooler.

Yet another object of the invention is to provide an ambient air modulator for an engine fluid heat exchanger having fixed louvers for streamlining the air flow therethrough.

Still another object of the invention is to provide an ambient air modulator for a vehicle-mounted engine fluid heat exchanger comprising a relatively thin flat plate disposed immediately adjacent the heat exchanger and slidable relative thereto in a rectilinear direction.

The foregoing object and others as may appear hereinafter are specifically met in a vehicle having an engine, a fan forward of the engine, and an ambient air-to-engine fluid heat exchanger, preferably a charge air cooler mounted forwardly of the fan and having a forward face with a plurality of ambient air openings equally spaced in one direction wherein an ambient air modulator in the form of an apertured plate is mounted adjacent the face of the heat exchanger and is controllably slidable to bring the plate apertures in registry with the ambient air openings of the heat exchanger. If the heat exchanger is for engine coolant, the front face of the heat exchanger comprises a second plate having the heat exchanger ambient air openings therein. If it is a charge air cooler, a second plate is unnecessary because, in an air-to-air heat exchanger, the charge air tubes are about the same width as the ambient air passages and thus the tubes can block the air flow through the modulator apertures when the plate is positioned to do so. The modulator plate is further preferably provided with integral louver portions between the apertures for channelling and streamlining the ambient air flow into the apertures and heat exchanger.

DETAILED DESCRIPTION OF THE DRAWINGS

Other objects and advantages of the invention will become more apparent upon reading the detailed description thereof and upon reference to the drawings in which:

FIG. 4 is an exploded view of the mounting of the ambient air modulator on the charge air cooler of FIG. 2;

FIG. 5 is an alternative view, rotated 180° for convenience, illustrating the mounting of the ambient air modulator on the radiator; and FIG. 6 is an enlarged sectional view similar to FIG. 3 but illustrating the interface of the radiator of FIG. 5 with a ambient air modulator.

DETAILED DESCRIPTION OF THE INVENTION

Figure 1:
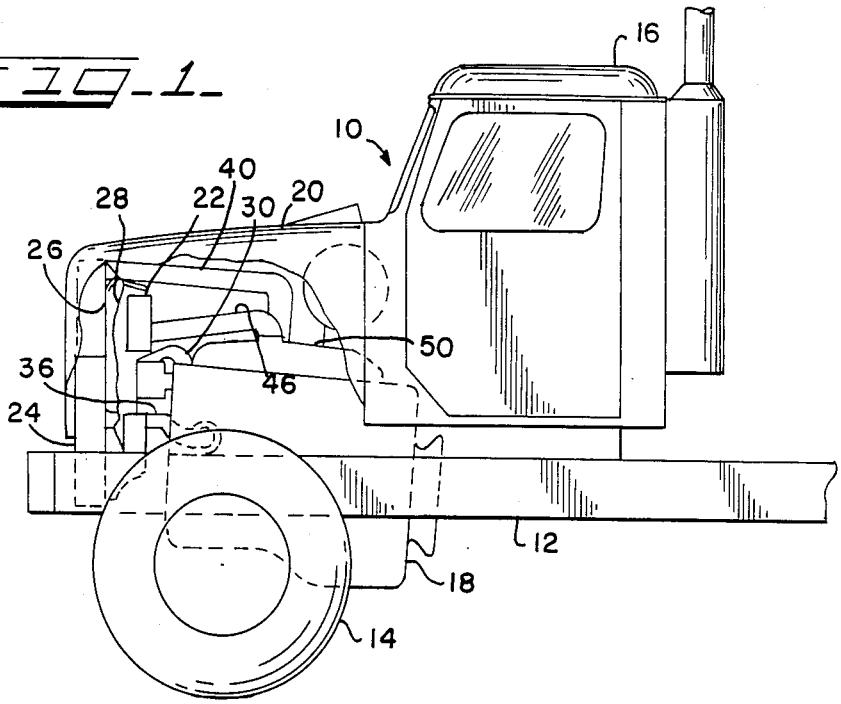
FIG. 1 is a side view of the front end of a highway truck incorporating the present invention.
Figure 2:
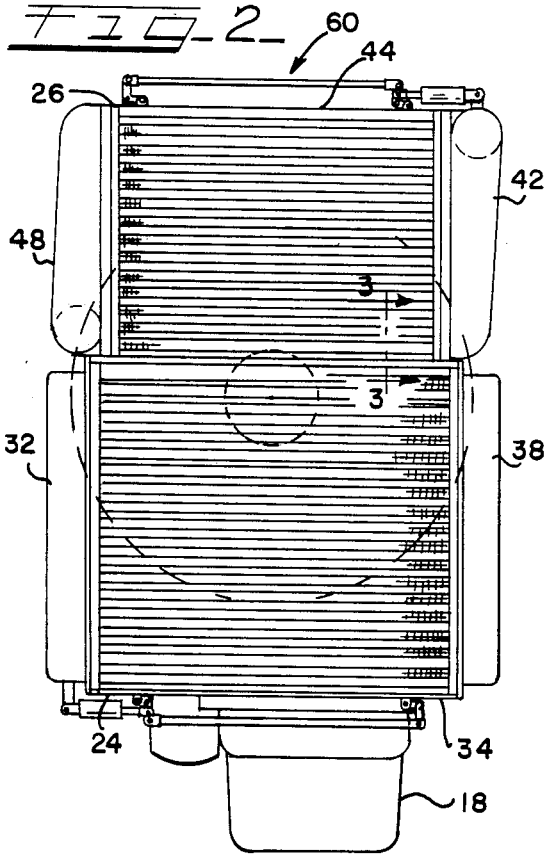
FIG. 2 is a front view of the engine fluid heat exchangers of the highway truck of FIG. 1 showing the present invention mounted on a charge air cooler and on the radiator.

Referring now to FIG. 1, there is shown the front portion of a highway truck generally designated 10 having a mobile main frame 12 supported by ground wheels, of which being shown at 14. An operator's cab 16 is mounted on the frame 12 and an engine 18 is mounted on the frame assembly forwardly of the cab 16 inside hood 20. A cooling fan 22 mounted to the front of the engine 18 and driven thereby, is disposed within a shroud structure 28 attached to the rear of a stacked heat exchanger structure comprising a radiator 24 and a charge air cooler 26, the shroud structure 28 being adapted to channel all the air flowing through through the radiator 24 and charge air cooler 26 to the fan 22.

The engine is further provided with a coolant outlet connected by hose 30 to a header 32 disposed on one side of liquid-to-air heat exchanger cooler 34 of radiator 24 and a coolant inlet connected by hose 36 to header 38 attached to the opposite side of core 34, thus establishing a conventional engine cooling system. Similarly, the engine, which is turbocharged, has a charge air outlet hose 40 which extends between the engine turbocharger (not shown) and header 42 attached to an air-to-air heat exchanger core 44 of charge air cooler 28 and a charge air inlet hose 36 which extends between header 48 of charge air cooler 28 and intake manifold 50 of engine 18, establishing a conventional (except for the stacked charge air cooler and radiator) charge air cooling system for the truck 10.

In accordance with the invention, an ambient air modulator generally designated 60 is provided for the charge air cooler 26. More specifically, as best seen in FIG. 4, the charge air cooler 26 is provided with a pair of opposed upstanding channel members 62 which are bolted to the respective headers 42 and 48 at each end of the core, the channel members 62 defining with the core a pair of opposed vertical slots 64. An apertured modulator plate 66 has its edges slidably received in the slots 64 so that the modulator plate 66 is disposed immediately adjacent the front face of the core 44 and is capable of rectilinear motion relative thereto and, as will be seen in FIG. 3, perpendicular to the direction of the charge air tubes 70 of the core 44. The modulator plate 66 is further provided at its top edge with tabs 72 adjacent each side which are pivotally connected as by pins respectively to the ends of levers 74 and 76 which are in turn pivotally connected to mounting tabs 78 attached to the core assembly 44. A cross link 80 pivotally interconnects the levers 74 and 76 to form a four bar linkage providing vertical movement of the modulator plate 66 upon movement of the lever 76. A conventional thermoelongating device 82 which is responsive to the temperature in the intake manifold 50 is connected between the lever 76 and mounting tab 84 attached to the header 42.

The modulator plate 66 is provided with a plurality of transversely extending apertures 90 which are equally spaced in the direction of movement of the plate. Preferably, the size of the apertures in the direction of movement is greater than or equal to the ambient air openings 71 between the tubes 70 of the charge air cooler 26 to prevent restriction of the air flow therethrough when the modulator should be wide open. Conversely, the thickness of the plate portions 92 between the apertures 90 should be less than or equal to the thickness of the charge air tubes 70. Ideally, the apertures 90 and plate portions 92 will be of equal size as will the charge air tubes 70 and the ambient air openings 71 of the charge air cooler 26 which will produce both wide open or fully closed positions of the ambient air modulated charge air cooler.

Figure 3:
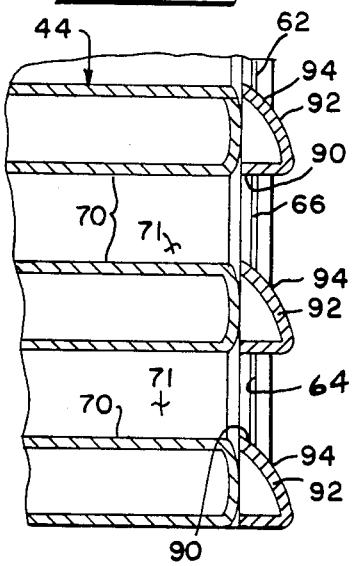
FIG. 3 is an enlarged sectional view of the interface between the charge air cooler and ambient air modulator of FIG. 2.

It will further be seen from FIG. 3, that the portions 92 of the modulator plate between the apertures 90 are formed as louvers 94 having arcuate surfaces disposed to streamline the flow of ambient air into the ambient air openings 71 of the charge air cooler. Ideally, the louvers 94 are integrally formed into the plate 66; however, the louvers 94 could be separate pieces attached to the plate 66 and could be decorative to form an attractive grille.

In operation, the thermoelongating device 82 contracts or expands in response to the temperature in the intake manifold 50 of engine 18 and moves the lever 76 controlling the linkage which in turn moves the modulator plate 66 to vary the amount of ambient air passing through the charge air cooler 26 and thus regulates the amount of cooling of the charge air.

FIGS. 5 and 6 illustrate a second embodiment of the ambient air modulator applied to the radiator 24 of the truck 10. In this regard, the structure and operation of the modulator assembly is substantially identical with the foregoing described modulator except that the thermoelongating element 82 is responsive to the water temperature in the engine water pump inlet hose 36 and a second modulator plate 100 has been added between the front of the radiator core 34 and the modulator plate 66. The secondary modulator plate 100 is also provided with a plurality of transversely extending, equally spaced apertures 102 which are the same width, in the direction of movement, as the apertures 90 in the modulator plate 66. The secondary plate 100 is necessary because the coolant tubes 104 of the radiator core 34 are much smaller than the ambient air openings therein. Accordingly, the ambient air modulation is done between the modulator plate 66 and the secondary modulator plate 100.

Although the use of the ambient air modulator disclosed herein on a radiator 24 would appear to be more restrictive than a conventional shutter system, the modulator plates 66 and 100 being single pieces could easily be removed for summer operation with no restriction. A significant advantage over a conventional shutter system arises when both the charge air cooler and the radiator are equipped with the ambient air modulators described herein since independent control of the intake manifold and water inlet temperatures is achieved. Indeed, such advantage would arise even if the charge air cooler were positioned forward of the radiator and received its ambient air before the air had passed through the radiator.

Thus, there has been described in accordance with the invention, an ambient air modulator which fully meets the objects, aims and advantages set forth above. It is apparent that in view of the foregoing description other modifications and alternatives will become apparent to those of ordinary skill in the art without departing from the true scope of the invention. Accordingly, it is intended to embrace all such alterations and modifications as may come within the scope of the appended claims.

What is claimed is:

1. In a vehicle of the type having a mobile frame, a turbocharged engine mounted on the frame, a cooling fan mounted forwardly of the engine, a charge air heat exchanger mounted forwardly of the fan, said heat exchanger having a substantially rectangular core including a plurality of ambient air openings disposed across the front surface of said heat exchanger, said openings being equally spaced in one direction and of a size at least equal to the space between said openings, and an ambient air modulator disposed forwardly of said heat exchanger, said modulator including control means responsive to the temperature of the engine fluid for regulating the flow of ambient air to said heat exchanger, the improvement wherein said ambient air modulator comprises a thin plate substantially enclosing the entire forward face of said heat exchanger core without intervening structure and disposed for rectilinear sliding movements relative thereto in said one direction, said thin plate having a plurality of apertures therein equally spaced in said one direction and disposed to permit variable registration of said apertures with said heat exchanger openings in response to said air modulator control means.

2. The invention in accordance with claim 1 and said heat exchanger comprising alternately disposed charge air tubes and air openings therebetween, the width of the portion of said thin plate between said ambient air apertures in said plate being equal to or greater than said air openings.

3. The invention in accordance with claim 1 and said heat exchanger having charge air tubes and the width of the portion of said thin plate between said apertures being equal to or less than the thickness of the charge air tubes.

4. The invention in accordance with claim 3 and the portion of said thin plate between said apertures being formed as louvers disposed to channel ambient air flow smoothly into said apertures.

5. A charge air cooler assembly for a turbocharged engine comprising:

a core assembly comprising a plurality of charge air tubes extending in parallel relation from a first side of the core to a second side and defining ambient air openings extending perpendicular to said charge air tubes extending through said core, said charge air tubes and said air openings being alternately disposed along a face side of said core perpendicular to said first and second sides, the spacing of said charge air tubes being approximately equal to the thickness of said tubes along said face;

an apertured plate slidably mounted to said charge air cooler adjacent said entire face of said core without intervening structure for movement perpendicular to said charge air tubes between an open position permitting air flow in a closed position preventing air flow, the apertures in said plate being disposed to align with said charge air tubes in said closed position and with said air openings in said open position.

6. The invention in accordance with claim 5 and a control means for causing movement of said plate.

7. The invention in accordance with claim 6 and said control means automatically causing said sliding movements in response to the temperature of the charge air exitting said heat exchanger.

8. The invention in accordance with claim 5 and said charge air cooler having upstanding channel members attached thereo respectively adjacent said sides and defining opposing slots, said apertured plate being received in said slots.

9. The invention in accordanced with claim 8 and interconnected parallel link means interconnecting said plate and said charge air cooler core adjacent each side of said plate for effecting uniform sliding movements of said plate.

10. The invention in accordance with claim 9 and a thermostatic element responsive to the temperature of the charge air on the discharge side of said charge air cooler connected to and disposed to move one of said parallel links.

11. The invention in accordance with claim 5 and louvers being disposed on said plate adjacent said apertures and configured for streamlining the flow of air through said apertures into said openings.

* * * * *

UNITED STATES PATENT AND TRADEMARK OFFICE

CERTIFICATE OF CORRECTION

PATENT NO. : 4,706,461

DATED : November 17, 1987

INVENTOR(S) : Howard L. Pratt

It is certified that error appears in the above—identified patent and that said Letters Patent is hereby corrected as shown below:

Title page:

Delete Robert J. Selzer as an inventor.

Item [19] "Pratt et al" should read --Pratt--.

Signed and Sealed this

Seventeenth Day of May, 1988

*Attest:*

*Attesting Officer*

DONALD J. QUIGG

*Commissioner of Patents and Trademarks*